US006062294A

United States Patent [19]

Yukisawa et al.

[11] Patent Number: 6,062,294

[45] **Date of Patent: *May 16, 2000**

[54] INJECTION MOLDING MACHINE AND INJECTION MOLDING METHOD

[75] Inventors: Saburo Yukisawa; Shinji Akimoto; Tatsuyoshi Miyazaki, all of Toyama-ken, Japan

[73] Assignee: YKK Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/027,951

[22] Filed: Feb. 24, 1998

[30] Foreign Application Priority Data

Feb. 25, 1997 [JP] Japan ..... 9-058531

[51] Int. Cl.[7] ..... B22D 17/04

[52] U.S. Cl. ..... 164/113; 164/317; 164/318

[58] Field of Search ..... 164/457, 155.4, 164/154.2, 113, 312, 316, 317, 318

[56] References Cited

U.S. PATENT DOCUMENTS 3,777,943 12/1973 Spalding et al. ..... 164/318

FOREIGN PATENT DOCUMENTS 17560 of 1915 United Kingdom ..... 164/316 .....

*Primary Examiner*—Kuang Y. Lin

*Attorney, Agent, or Firm*—Hill & Simpson

*Attorney, Agent, or Firm*—

[57] ABSTRACT

An injection molding machine having a simple structure and adapted to quickly operate for injection molding without taking in air bubbles is provided. The injection molding machine comprises a plunger and a nozzle for injecting the molten metal fed from the plunger into a metal mold. The plunger has a cylinder section with a through hole bored through an upper portion of its lateral wall for introducing the molten metal, and a piston for slidingly reciprocating within the cylinder section. A communication hole is bored through the piston and communicates with the through hole at a predetermined position. The communication hole runs from the lateral wall of the piston through the inside thereof and has a non-return valve arranged therein to allow only a flow from the lateral wall of the piston.

3 Claims, 4 Drawing Sheets

INJECTION MOLDING MACHINE AND INJECTION MOLDING METHOD

BACKGROUND OF THE INVENTION

1. Field of the Invention

This invention relates to an injection molding machine for molding a product having a desired profile by injecting molten metal into a metal mold by means of a plunger, and an injection molding method for molding such a product.

2. Prior Art

FIGS. 3A and 3B of the accompanying drawings illustrate a typical known metal molding machine comprising a melting pot (not shown) for storing molten metal 10' and a plunger 12' having a lower portion dipped into the molten metal 10' in the melting pot, wherein the molten metal 10' is fed from the plunger 12' to an injection nozzle 14' and then injected into a metal mold 16'. The plunger 12' has a cylinder section 18' dipped into the molten metal 10' and a piston 20' that slidingly reciprocates within the cylinder section 18', which cylinder section 18' has a through hole 22' bored through an upper portion of its lateral wall, through which the molten metal 10' is drawn into the cylinder section 18'. A rod 24' is linked to the piston 20' at an end thereof and to a corresponding rod 28' of another piston 30' housed in a hydraulic cylinder 26' at the other end.

The illustrated known injection molding machine operates in a manner as described below. Firstly as shown in FIG. 3A, the piston 30' of the hydraulic cylinder 26' is raised to pull up the piston 20' of the plunger 12' above the through hole 22' by way of the rods 24' and 28'. Since the through hole 22' is located below the surface L' of the molten metal 10', the molten metal 10' flows into the cylinder section 18'. Subsequently, the piston 30' of the hydraulic cylinder 26' is moved downward to lower the piston 20' of the plunger 12', and after the piston 20' passes the through hole 22', the molten metal 10' is forced in the cylinder section 18' to move out toward the nozzle 14' until it is injected into a cavity of the metal mold 16' through the outlet of the nozzle 14'. When the metal in the metal mold 16' is solidified, the metal mold 16' is opened to take out the molded product. Thereafter the piston 30' of the hydraulic cylinder 26' is raised to pull up the piston 20' of the plunger 12', as shown in FIG. 3B. Then, the molten metal 10' in the cylinder section 18' moves back from the nozzle 14' as the piston 20' is pulled up, and once the piston 20' passes by the through hole 22', falls until its surface is flush with the level L' of the surface of the molten metal 10' in the melting pot because the inside of the plunger 12' is subjected to the atmospheric pressure.

With the above described prior art metal mold machine, the molten metal 10' in the nozzle 14' is forced to move back and forth in each injection molding cycle between the nozzle tip and the level of the molten metal 10' in the melting pot to cover a relatively long traveling distance so that the molten metal 10' can take in bubbles to a large extent at the time of injection. Additionally, a long traveling distance means a long injection molding cycle time and a low efficiency.

In view of the above identified technological problems, it is therefore an object of the present invention to provide an injection molding machine having a simple structure and adapted to operate for injection molding with a short cycle time and the molten metal in it hardly takes in air bubbles, and to provide an injection molding method practiced with the machine.

SUMMARY OF THE INVENTION

According to the invention, the above object is achieved by providing an injection molding machine comprising a plunger having a cylinder section with a through hole bored through an upper portion of its lateral wall for introducing the molten metal, a nozzle for injecting molten metal fed from the plunger into a metal mold, and a piston for slidingly reciprocating within the cylinder. In the injection molding machine, a communication hole is bored through the piston and communicates with the through hole at a predetermined position. The communication hole runs from the lateral wall of the piston through the inside thereof and has a non-return valve arranged therein to allow only a flow from the lateral wall of the piston.

Preferably, the communication hole is open at the lateral wall of the piston and communicates with a groove formed all the way around the lateral wall of the piston. With such an arrangement, the communication hole of the piston communicates with the through hole whenever the piston is located at a predetermined level regardless of the position of its opening at the lateral wall.

With the injection molding machine according to the invention, the molten metal is fed into the cylinder by way of the through hole arranged at the lateral wall, the communication hole and the non-return valve of the piston after the piston is raised. Once the piston is lowered, the non-return valve in the piston is subjected to oppositely-directed pressure and, therefore, the molten metal within the cylinder cannot flow out through the communication hole and hence is injected into the metal mold through the nozzle without fail. As the piston is raised within the cylinder without opening the metal mold after the injection, negative pressure prevails the inside of the cylinder and, once the communication hole communicates with the through hole of the cylinder, the molten metal is introduced into the cylinder through the through hole, the communication hole and the non-return valve. When the metal mold is opened thereafter, the molten metal within the nozzle is subjected to the atmospheric pressure like the molten metal located outside but the non-return valve in the piston is subjected to pressure apt to close the non-return valve in the piston so that the molten metal within the nozzle cannot flow out and remains within the nozzle even if the level of the surface of the molten metal is located above the level of the surface of the outside molten metal.

According to the invention, there also provided an injection molding method which is practiced with the above described machine. In the method, the molten metal is fed into the cylinder section by way of the through hole and then the molten metal in the cylinder section is injected into the metal mold by moving the piston to slide and then to a position aligned with the through hole before opening the metal mold to take out a molded product.

DETAILED DESCRIPTION OF THE PREFERRED EMBODIMENT

Figure 1:
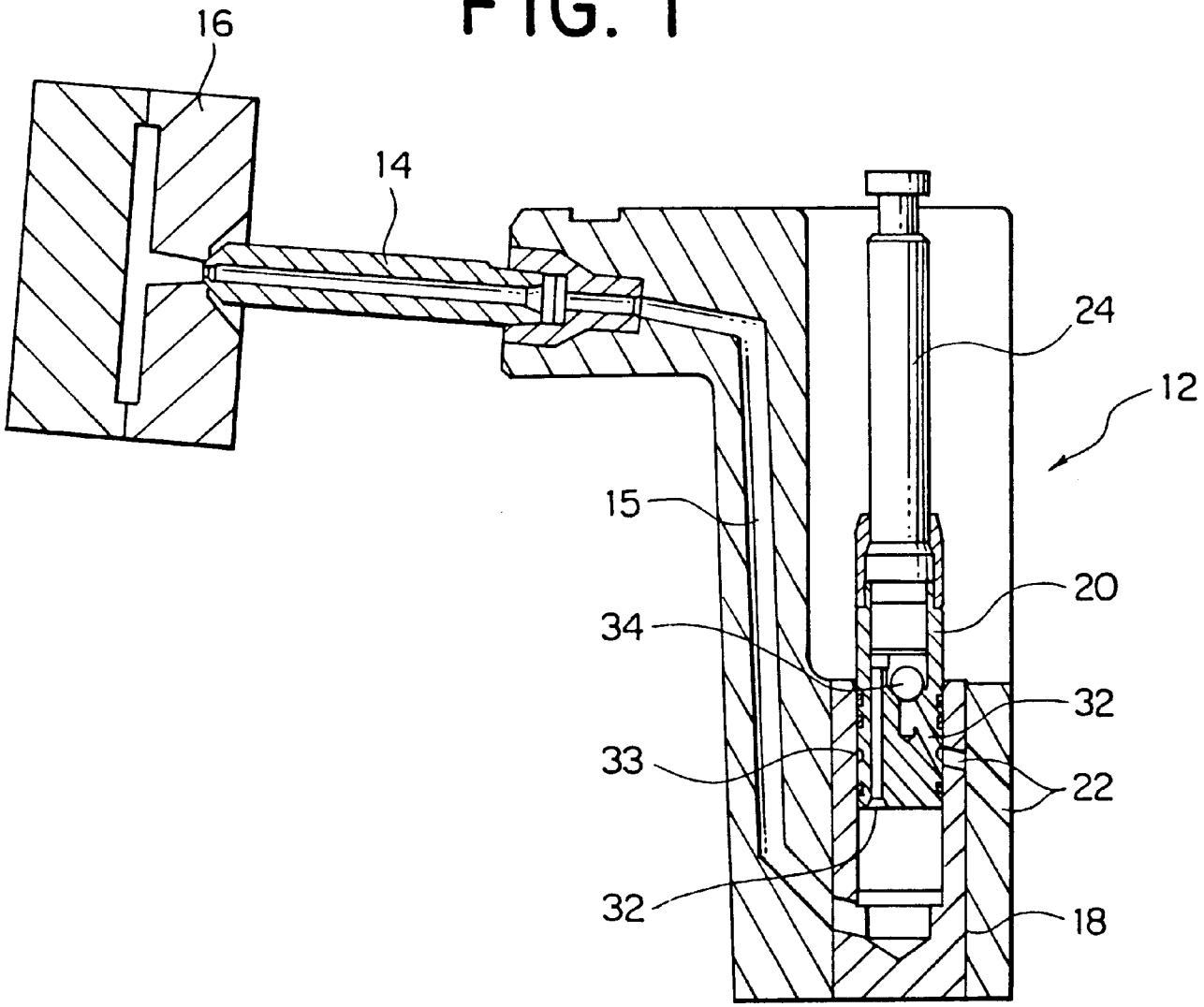
FIG. 1 is a schematic cross sectional view of an embodiment of injection molding machine according to the invention, showing its plunger.

Now, the present invention will be described by referring to the accompanying drawings that illustrate an embodiment of the invention. As shown in FIGS. 1 and 2, an injection molding machine is designed for injection molding of molten metal 10 such as zinc and comprises a melting pot (not shown) for storing molten metal 10 and a plunger 12 having a lower half dipped into the molten metal 10 in the melting pot. The plunger 12 has an injection path 15 for feeding the molten metal 10 to an injection nozzle 14 arranged at the front end of the injection path 15 and linked to an injection port 17 of a metal mold 16.

The plunger 12 comprises a cylinder section 18 dipped into the molten metal 10 and a piston 20 adapted to slidingly reciprocate within the cylinder section 18 and a through hole 22 is bored through the lateral wall of the cylinder 18 at an upper portion thereof to feed the molten metal 10 into the cylinder section 18.

The piston 20 has a communication hole 32 adapted to communicate with the through hole 22 provided at an upper portion of the cylinder section 18 and runs from the lateral wall to the bottom of the piston 20 through the inside thereof and a non-return valve 34 is arranged in the communication hole 32 to allow only a flow from the lateral wall toward the bottom of the piston 20. A groove 33 is formed all the way around the lateral wall of the piston and communicates with communication hole 32 by way of the opening of the latter at the lateral wall of the piston 20.

A rod 24 is secured to the piston 20 at an end thereof and linked at the opposite end to another rod 28 of another piston 30 of a hydraulic cylinder 26 located above the plunger 12. The hydraulic cylinder 26 is adapted to fed with and deliver hydraulic oil by way of ports 36 and 37 located above and below the piston 30 respectively.

Figure 2A:
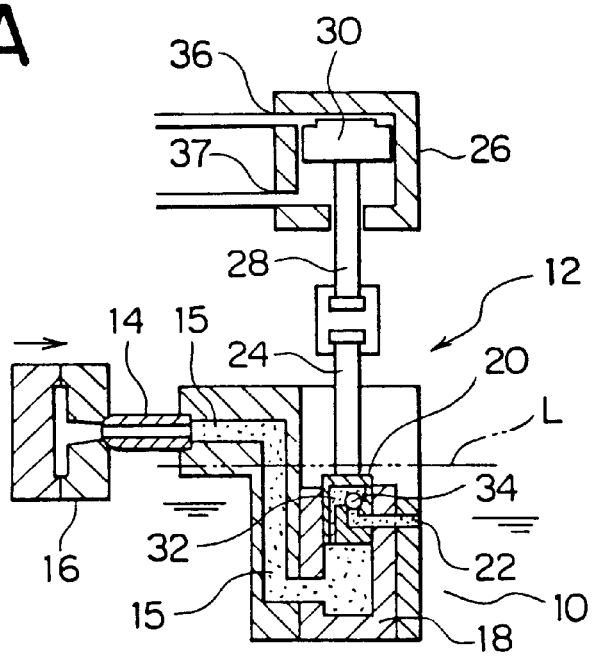
FIGS. 2A, 2B, 2C, and 2D are schematic cross sectional views of the embodiment of injection molding machine according to the invention, showing molding steps.
Figure 2B:
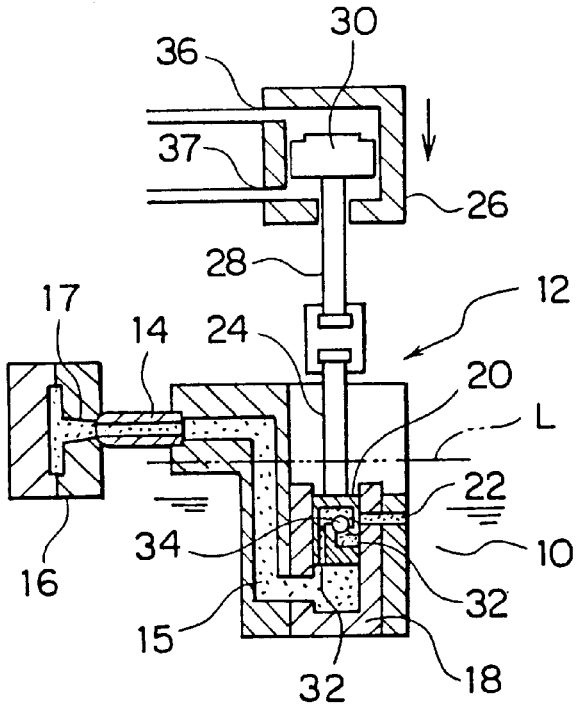

With the injection molding machine having a structure as described above, the level L of the surface of the molten metal 10 in the melting pot is located above the through hole 22 of the cylinder section 18 so that molten metal 10 is fed into the cylinder section 18 through the through hole 22. In an injection molding cycle, firstly the piston 20 is raised as shown in FIG. 2A until the lateral through hole 22 of the cylinder 18 comes into communication with the communication hole 32 of the piston 20, and the molten metal 10 flows into the cylinder section 18 through the through hole 22, the communication hole 32 and the non-return valve 34. When the piston 20 is lowered as shown in FIG. 2B, the non-return valve 34 in the piston 20 is subjected to pressure directed from the inside of the cylinder section 18 to the outside to close the non-return valve 34 so that any molten metal 10 in the cylinder cannot flow out through the communication hole 32.

Figure 2C:
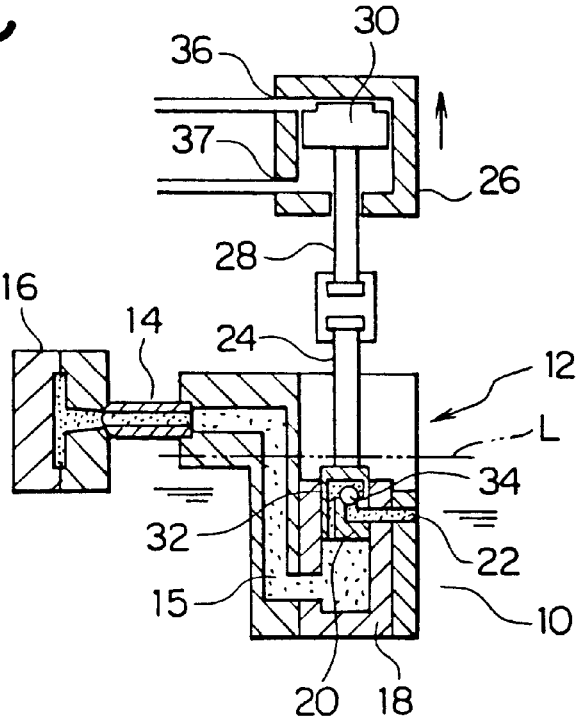
Figure 2D:
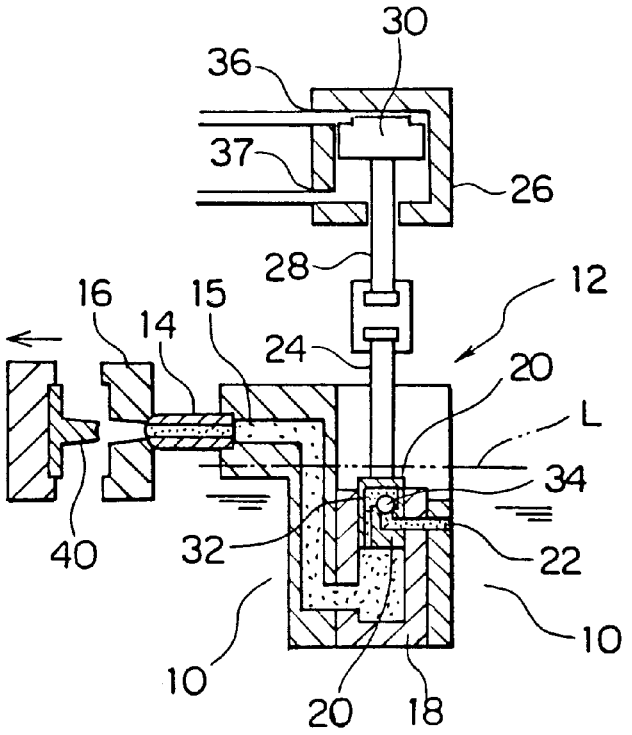
Figure 3A:
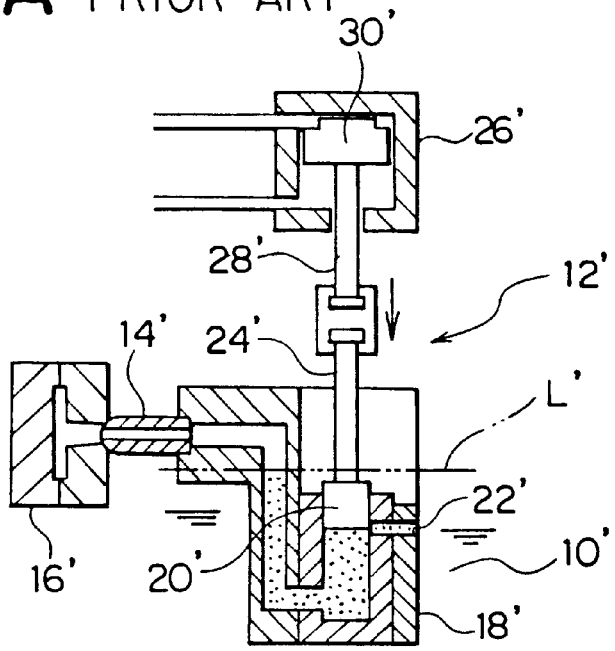
FIG. 3A PRIOR ART
FIGS. 3A and 3B are schematic cross sectional views of a known injection molding machine, showing molding steps.
Figure 3B:
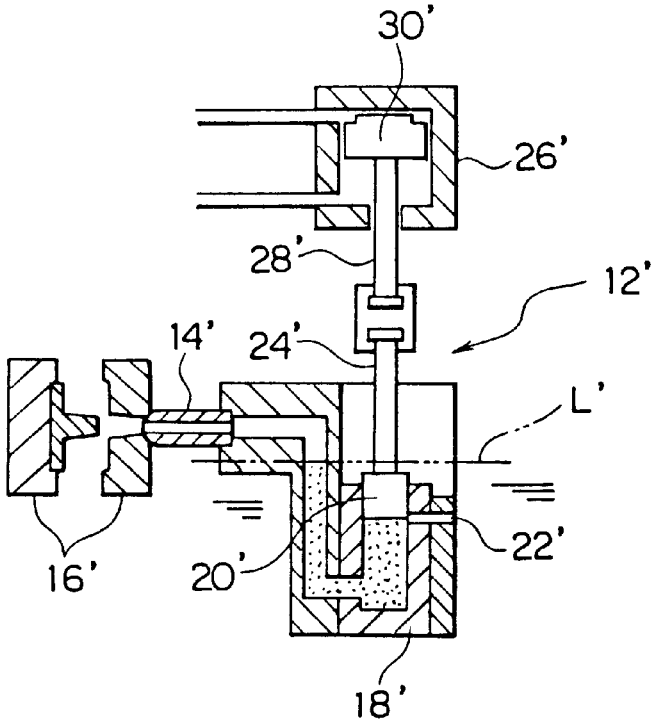
FIG. 3B PRIOR ART

The molten metal 10 in the cylinder section 18 is injected into the metal mold 16 by way of the injection path 15 as the piston 30 of the hydraulic cylinder 26 is lowered to push down the piston 20. After the injection, piston 20 is raised within the cylinder section 18 without opening the metal mold 16 as shown in FIG. 2C. As a result, negative pressure prevails within the cylinder section 18 so that, once the communication hole 32 comes into communication with the through hole 22 of the cylinder section 18, the molten metal 10 is drawn into the cylinder section 18 by way of the through hole 22, the communication hole 32 and the non-return valve 34. Thereafter, the metal mold 16 is opened and a molded product 40 is taken out form the metal mold when the injected metal is sufficiently cooled.

Under this condition, the molten metal 10 in the nozzle 14 is subjected to the atmospheric pressure like the molten metal 10 located outside. However, the surface level of the molten metal 10 in the nozzle 14 is located higher than that of the outside molten metal 10 so that the non-return valve 34 in the piston 20 is subjected to pressure to close it and hence the molten metal 10 in the nozzle 14 cannot flow out and is held within the nozzle 14. Then, another injection molding cycle starts from this condition in a manner as described above. Note that the nozzle 14 is filled with the molten metal 10 and the front end of the molten metal 10 does not move back under this condition.

With the above described embodiment of injection molding machine and the method of controlling the injection molding cycle, since the channel of molten metal 10 for injecting molten metal into the metal mold 16 can be made very short due to the effect of the non-return valve 34 in the piston 20, the time required for an injection molding cycle can be reduced. And the molten metal in the cylinder minimally takes in air bubbles as it travels in the injection molding cycle, and since the injection path down to the metal mold 16 is made very short, better quality of products can be realized.

Thus, an injection molding machine according to the invention would not produce defective products that contain air bubbles under the surface. It is structurally simple and operates reliably for injection molding.

With an injection molding method according to the invention, the piston 20 having a non-return valve 34 and arranged in the plunger 12 is employed and the metal mold 16 is opened only after the injection molding step to minimize the movement of molten metal 10 from the nozzle 14 so that it can quickly produce high quality injection molded products.

What is claimed:

1. An injection molding machine comprising:

(a) a plunger having a cylinder section with a through hole bored through an upper portion of its lateral wall for introducing molten metal;

(b) an injection nozzle flow connected to the plunger and to a metal mold;

(c) a piston slidingly reciprocating within the cylinder section and having first and second positions, said piston being provided with a communication hole which communicates with said through hole when the piston is in the first position and extends from the lateral wall of the piston through the inside of the piston, the communication hole being out of communication with the through hole when the piston is in the second position; and (d) a non-return valve provided in said communication hole, said non-returnvalve allowing only a flow from the lateral wall of said piston, wherein when the piston is moved from the second position toward the first position while the metal mold is closed the cylinder section has an internal pressure less than a pressure on a side of the non-return valve in fluid communication with the communication hole of the piston.

2. An injection molding machine according to claim 1, wherein said communication hole is open at the lateral wall of the piston and communicates with a groove formed all the way around the lateral wall of the piston.

3. An injection molding method comprising steps of:

(a) providing a plunger and a nozzle flow connected to a metal mold, wherein molten metal can be fed from the plunger to the metal mold;

(b) forming a through hole through an upper portion of a lateral wall of a cylinder section of said plunger for introducing the molten metal;

(c) providing a piston which slidingly reciprocates between first and second positions within the cylinder section in order to inject molten metal into the metal mold;

(d) forming a communication hole in said piston, said communication hole communicating with said through hole when the piston is in the first position and extending from the lateral wall of the piston through the inside of the piston;

(e) providing a non-return valve in said communication hole for allowing only a flow from the lateral wall of said piston;

(f) feeding the molten metal into said cylinder section by way of said through hole;

(g) injecting the molten metal in said cylinder section into said metal mold by moving said piston to the second position in which the communication hole is out of communication with the through hole, moving the piston from the second position toward the first position while the mold is closed, creating an internal pressure inside the piston which is less than a pressure on a side of the non-return valve in fluid communication with the communication hole of the piston, and then moving the piston to the first position aligned with said through hole before opening said metal mold to take out a molded product.

* * * * *